US009122299B2

(12) United States Patent
Martin

(10) Patent No.: US 9,122,299 B2
(45) Date of Patent: Sep. 1, 2015

(54) DISCONNECT LEVER AND METHOD OF MANUFACTURE

(71) Applicant: TYCO ELECTRONICS CORPORATION, Berwyn, PA (US)

(72) Inventor: Galen M. Martin, Camp Hill, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 176 days.

(21) Appl. No.: 13/833,502

(22) Filed: Mar. 15, 2013

(65) Prior Publication Data

US 2014/0260768 A1 Sep. 18, 2014

(51) Int. Cl.
*G05G 1/04* (2006.01)
*H01R 13/629* (2006.01)

(52) U.S. Cl.
CPC ..... *G05G 1/04* (2013.01); *H01R 13/62944* (2013.01); *Y10T 29/49826* (2015.01); *Y10T 74/20612* (2015.01)

(58) Field of Classification Search
CPC ..... Y10T 74/20582; Y10T 74/20618; H01R 13/62944; H01R 13/629; H01R 13/62955; H01R 13/62966; H01R 13/62972; G05G 1/04
See application file for complete search history.

(56) References Cited

U.S. PATENT DOCUMENTS

| | | | | |
|---|---|---|---|---|
| 6,558,176 | B1 * | 5/2003 | Martin et al. | 439/157 |
| 7,785,131 | B2 * | 8/2010 | Ferderer et al. | 439/372 |
| 2002/0074694 | A1 | 6/2002 | Kurimoto | |
| 2008/0076283 | A1 * | 3/2008 | Bouchan et al. | 439/157 |
| 2009/0246992 | A1 | 10/2009 | Martin | |

FOREIGN PATENT DOCUMENTS

| | | | |
|---|---|---|---|
| EP | 0 692 846 | A2 | 1/1996 |
| EP | 2 180 558 | A1 | 4/2010 |
| WO | 2010/070395 | A1 | 6/2010 |

OTHER PUBLICATIONS

Annex to Form PCT/ISA/206, Communication Relating to the Results of the Partial International Search, International Application No. PCT/US2014/020680, International Filing Date, Mar. 5, 2014.

* cited by examiner

*Primary Examiner* — Thomas Diaz

(57) ABSTRACT

A lever for use with a plug housing and a method of manufacturing. The method includes molding the housing and lever in one mold, with the housing and lever being separate parts. Extracting the housing and lever from the mold and moving a mating end of the lever into position relative to a mounting portion of the housing. The lever may include a first member having a first handle and a second member having a second handle which are mated together to form the lever. Additionally, the lever may have portions which are movably, hingedly or pivotably connected to a handle at a connection regions which are formed to provide a weakened area about which lever arms can move, rotate or pivot relative to the handle.

18 Claims, 3 Drawing Sheets

DISCONNECT LEVER AND METHOD OF MANUFACTURE

FIELD OF THE INVENTION

The invention is directed to a plug assembly, and more particularly, to a plug assembly with a lever that can be easily mounted to the housing and a method of molding the housing and lever of the plug assembly.

BACKGROUND OF THE INVENTION

Electrical connectors having a lever which is rotated to bring the plug assembly into position within a header find broad use in connector technology, particularly in automotive technology. The levers have gear teeth which mesh with complementary teeth on the header, in a rack and pinion fashion, to draw the plug assembly into electrical connection with the header.

One such plug assembly is shown in US Patent Publication Number 2009/0246992. The plug assembly includes a plug housing and a lever, where the lever includes gear teeth which cooperate with a tooth on a header in a rack and pinion fashion. The lever is locked to the plug housing when the lever is poised for the plug housing to be inserted into the header. A release member on the header releases the lever from the locked position allowing the lever to be rotated to the position where the lever gear teeth mesh with the header tooth, to draw the plug assembly into the header.

Typically, the levers and the housing are molded separately in two molds and assembled together in post molding operations. As each of the components is molded separately, the lever and the housing must be handled separately and assembled together. This introduces handling costs and also increase material costs as waste is produced in both of the molding operations. It would, therefore, be beneficial to provide a header assembly in which the housing and the lever are molded in the same mold and are assembled shortly after extraction from the mold cavity.

SUMMARY OF THE INVENTION

An exemplary embodiment method of manufacturing a plug housing and a lever is disclosed. The method comprising: molding the housing and lever in one mold, the housing and lever being separate parts; extracting the housing and lever from the mold; and moving a mating end of the lever into position relative to a mounting portion of the housing.

An exemplary embodiment is a lever for use with a housing. The lever includes a first lever arm and a second lever arm. The first lever arm is movably, hingedly or pivotably connected to a handle at a first connection region. The first connection region is formed to provide a weakened area about which the first lever arm can move, rotate or pivot relative to the handle. The second lever arm is movably, hingedly or pivotably connected to the handle at a second connection region. The second connection region is formed to provide a weakened area about which the second lever arm can move, rotate or pivot relative to the handle.

An exemplary embodiment is a lever for use with a plug housing. The lever includes a first member having a first handle and a second member having a second handle. The first member has a first handle and a first lever arm, the first lever arm is connected to a first central hub having a first raised portion which includes a first gear tooth and a first locking surface. A first central bore extends through the first central hub and is profiled to be received over a first mounting portion of the plug housing. The first member has a projection which extends from an end of the first handle. The second member has a second handle and a second lever arm, the second lever arm is connected to a second central hub having a second raised portion which includes a second gear tooth and a second locking surface. A second central bore extends through the second central hub and is profiled to be received over a second mounting portion of the plug housing. The second member has a recess which is provide at an end of the second handle. The projection cooperates with the recess when the first handle and second handle are mated together to form the lever.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
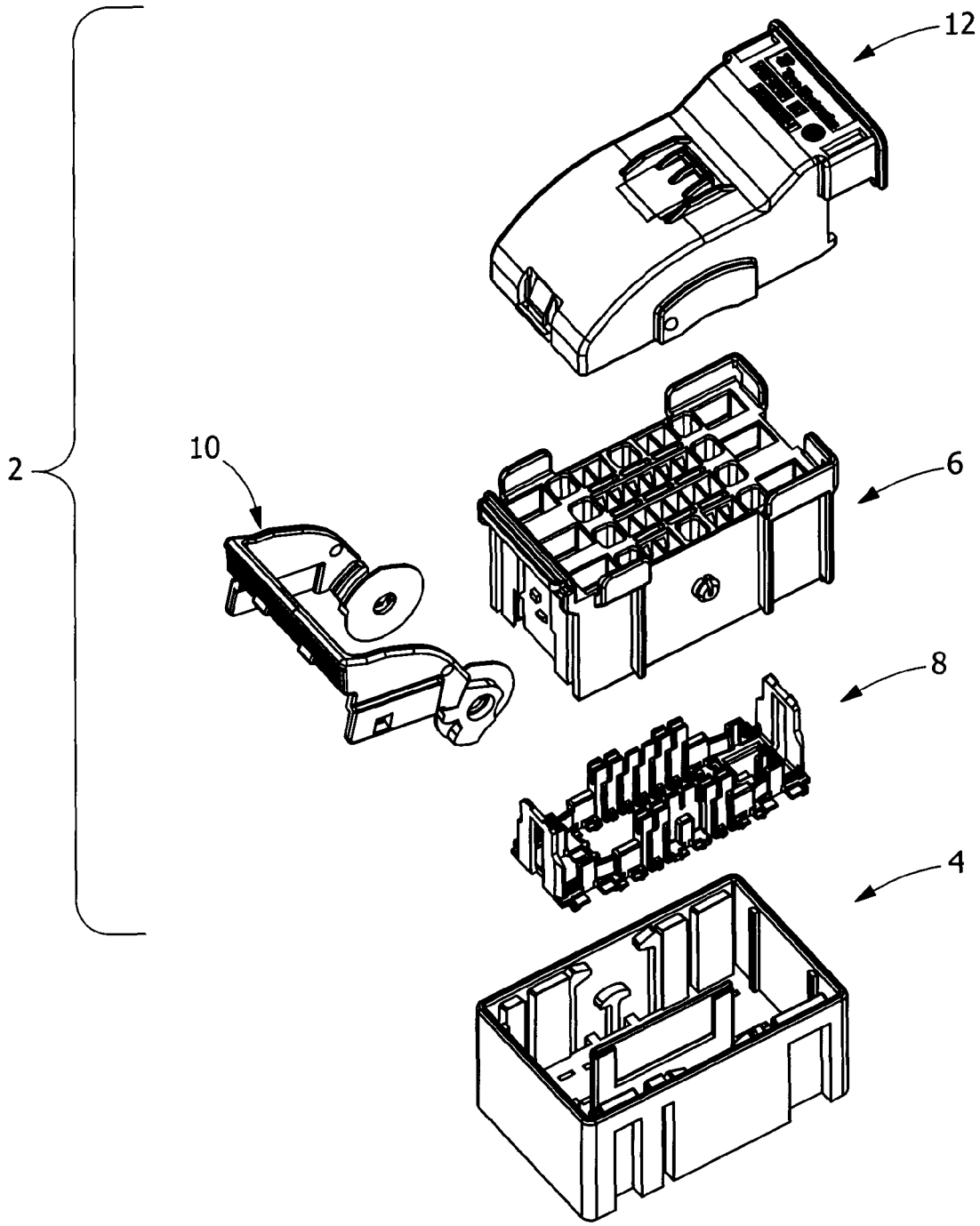
FIG. 1 is an exploded view of an exemplary embodiment of a plug assembly in which a header assembly is used.

The present invention will be described more fully hereinafter with reference to the accompanying drawings, in which illustrative or exemplary embodiments of the invention are shown. In the drawings, the relative sizes of regions or features may be exaggerated for clarity. This invention may, however, be embodied in many different forms and should not be construed as limited to the exemplary embodiments set forth herein; rather, these embodiments are provided so that this disclosure will be thorough and complete, and will fully convey the scope of the invention to those skilled in the art.

It will be understood that spatially relative terms, such as "right", and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "right" other elements or features would then be oriented "left" of the other elements or features. Thus, the exemplary term "right" can encompass both an orientation of right and left. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise.

Referring first to FIG. 1, an exemplary plug assembly 2 is shown in an exploded manner poised for receipt within a header 4. The plug assembly 2 is comprised of a plug housing 6, a terminal position assurance member (TPA) 8, a lever 10 and a wire shroud 12.

Figure 4:
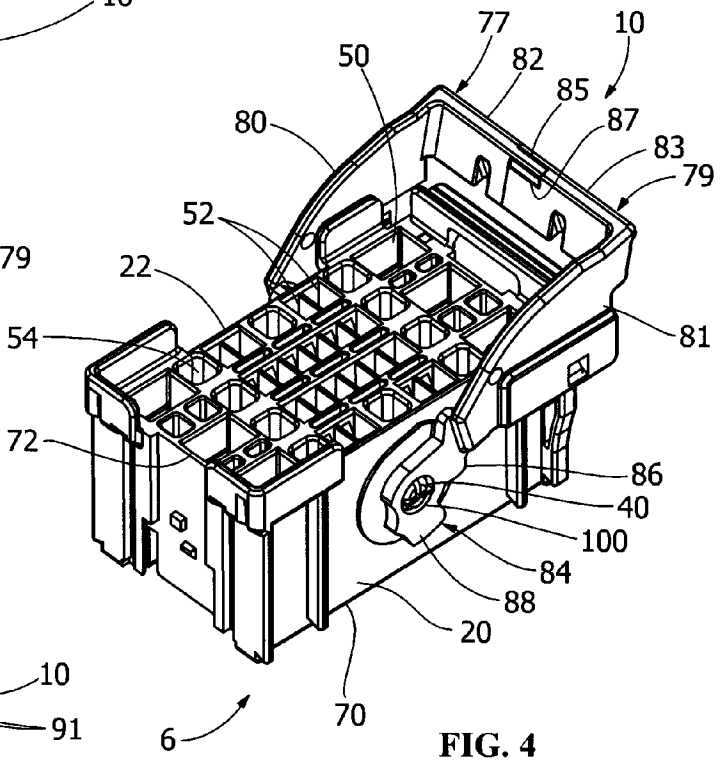
FIG. 4 is a perspective view of the exemplary header assembly of FIG. 3.
Figure 3:
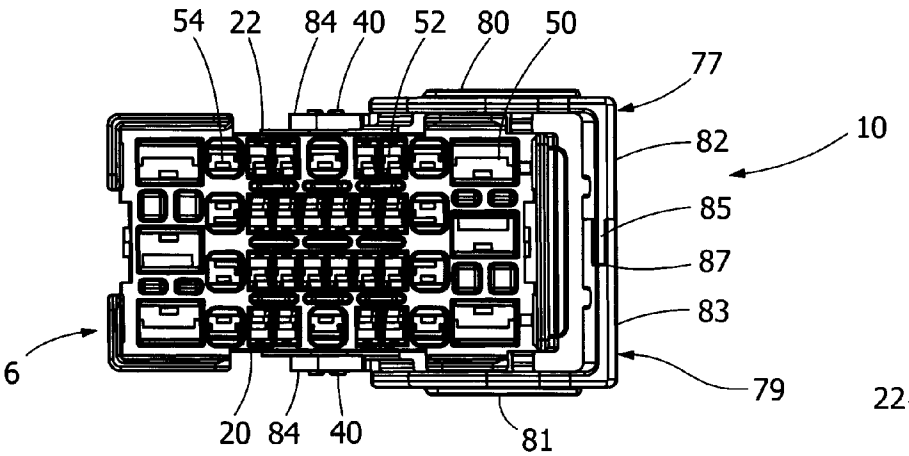
FIG. 3 is a top view of the exemplary header assembly of FIG. 2 showing the lever fully inserted onto the housing.
Figure 2:
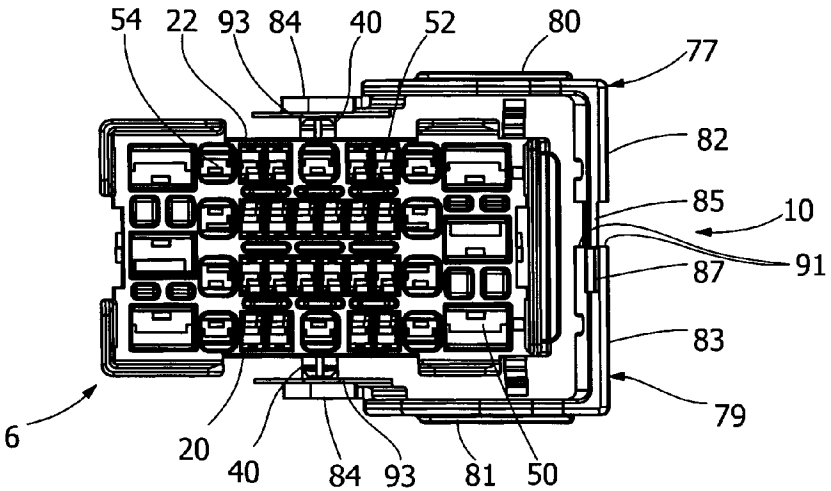
FIG. 2 is a top view of components of the exemplary header assembly of FIG. 1 showing the relative position of a housing and a lever during molding of the components.

As best shown in FIGS. 2 through 4, the exemplary plug housing 6 has oppositely facing sidewalls 20 and 22. Sidewalls 20 and 22 each include a pivot mount or mounting portion 40 in the form of a cylindrical pin. The plug housing 6 includes terminal receiving cavities such as 50, 52, and 54. In the exemplary embodiment shown, the cavities 50, 52, and 54 extend between a mating face 70 (FIG. 4) and a terminal receiving face 72 (FIG. 4). However, other configurations of the terminal receiving cavities, the sidewalls and the pivot mount may be implemented without departing from the scope of the invention, for example the pivot mount may be any form of mating projection which is configured to accept and mate with the lever.

In the exemplary embodiment shown in FIGS. 2 through 4, the lever 10 has a first member 77 and a second member 79. First member 77 has a lever arm 80 connected to a handle 82. Second member 79 has a lever arm 81 connected to a handle 83. Each lever arm 80, 81 is connected to a central hub 84. In the exemplary embodiment and as best shown in FIG. 4, each central hub 84 has a raised portion 86 which includes gear teeth 88. A central bore 100 extends entirely through the central hub 84 and is profiled to be received over mounting portion 40. However, other embodiments of the central hub may be substituted without departing from the scope of the invention.

The first member 77 has a projection 85 which extends from the end of the handle 82 which is spaced from the lever arm 80. The second member 79 has a recess 87 which extends inward from the end of the handle 83 toward the lever arm 81. The projection 85 cooperates with the recess 87 when the handles 82, 83 are mated together to form the lever 10, as will be more fully described below.

The assembly of the plug assembly 2 includes the termination of multiple insulated conductors (not shown) to multiple socket contacts (not shown), and then loading the contacts into the various apertures 50, 52, 54. The conductors would be dressed to one side of the housing, i.e. to the right as viewed in FIG. 1. The wire shroud 12 would be snap-latched to the plug housing 6. The TPA 8 will then be snap-loaded into the mating end of plug housing 6 to insure the correct positioning of the various socket terminals. It should also be appreciated that lever 10 is positionable over the pivot mount 40 such that the lever 10 is moveable between positions where the plug assembly 2 may be inserted into header 4, to where the plug assembly 2 is fully locked within the header 4.

Once assembled, the operation of the lever 10, plug housing 6 and plug assembly 2 is identical to the operation of the lever, plug housing and plug assembly shown and described in co-pending U.S. patent application Ser. No. 12/409,643 filed on Mar. 24, 2009, which is hereby incorporated by reference herein. The incorporation of U.S. patent application Ser. No. 12/409,643 is meant to be illustrative rather than limiting and various features may be changed without departing from the scope of this invention.

As previously described, the lever 10 is comprised of a first member 77 and a second member 79. During manufacture of the plug housing 6 and the lever 10, the first member 77 and the second member 79 are molded in one mold with the housing 6, as represented by FIG. 2. The first member 77, the second member 79 and the housing 6 are essentially separate pieces with weak webs 91, 93 being positioned between the first member 77, second member 79 and housing 6 to maintain each of the components in position relative to each other and allow the flow of material during molding to be facilitates. Webs 91 are positioned between the projection 85 of the first member 77 and the walls of the recess 87 of the second member 79. This maintains the ends handles 82, 83 in position relative to each other when the members 77, 79 are ejected from the mold. Webs 93 are positioned between the mounting portions 40 of the housing and the hubs 84 of the levers arms 80, 81 of the first member 77 and the second member 79. This maintains the lever arms 80, 81 in position relative to the mounting portions 40 when the members 77, 79 and housing 6 are ejected from the mold. The separation of the first member 77, the second member 79 and the housing 6 in the mold allows the complete formation of all of the components.

Upon removal from the mold cavity, the lever 10 is maintained in position relative to the housing 6 by webs 91, 93. During assembly of the lever 10 to the plug housing 6, the first member 77 and the second member 79 are moved into engagement with each other as the first member 77 and second member 79 are moved toward respective mounting portions 40. As this occurs, the forces applied to the members 77, 79 are sufficient to overcome the resistance of the webs 91, thereby breaking the connections between the first member 77 and the second member 79. As his occurs, the projection 85 of the handle 82 of the first member 77 is moved into the recess 87 of the handle 83 of the second member 79. As the insertion of the projection 85 into the recess 87 continues, the walls of the projection 85 and the walls of the recess 87 frictionally engage, thereby providing a frictional engagement between the projection 85 and recess 87 to maintain the first member 77 in position relative to the second member 79. Additionally projections may be provided on either of the projection 85 or recess 87 to provide additional securing of the members 77, 79. Once secured, the first member 77 and second member 79 cooperate to function as one lever 10.

Figure 7:
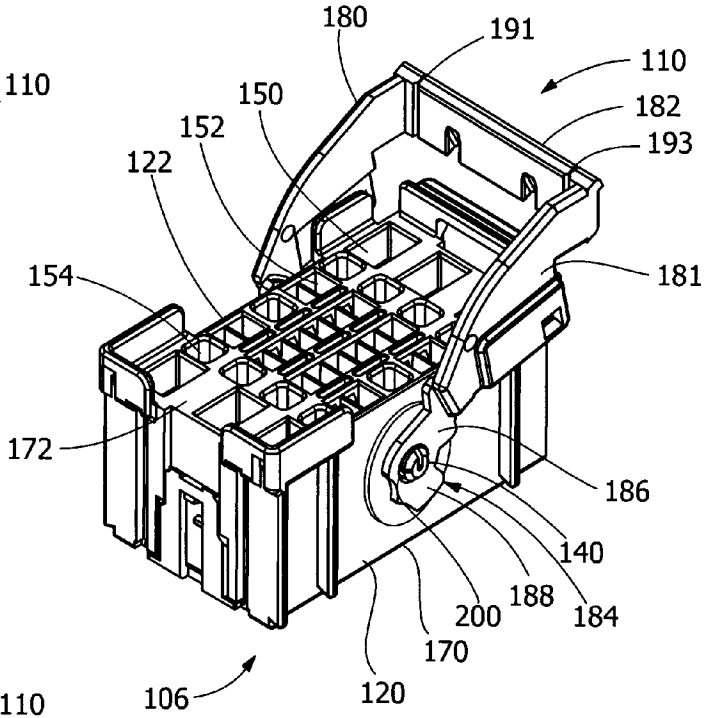
FIG. 7 is a perspective view of the exemplary header assembly of FIG. 6.
Figure 6:
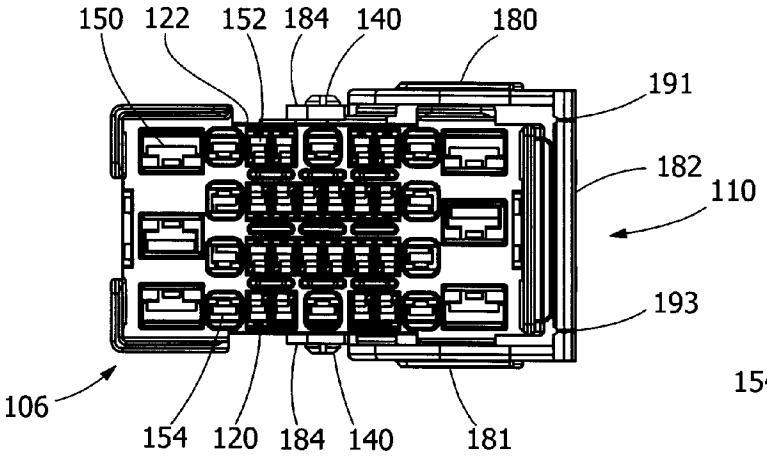
FIG. 6 is a top view of the alternate exemplary header assembly of FIG. 5 showing the lever fully inserted onto the housing.

In the exemplary embodiment shown, as the first member 77 and the second member 79 are moved together, the central hub 84 of each lever arm 80, 81 is moved into engagement with the mounting portion 40. As this occurs, the forces applied to the members 77, 79 are sufficient to overcome the resistance of the webs 93, thereby breaking the connections between the between the housing 6 and the first and second members 77, 79. As this occurs, the central bore 100 is received over mounting portion 40. Once the central bores 100 are properly mated to the mounting portions 40, the first and second members are mated with the housing, and the engagement of the central hubs 84 with the mounting portions 40 maintains the first member 77 in position relative to the second member 79, as shown in FIGS. 6 and 7, thereby preventing the disengagement of the first member 77 from the second member 79. This allows the lever 10 to operate in the manner previously described.

According to the present invention, the housing 6 and lever 10 are molded as distinct and separate pieces but are molded in the same mold with webs interconnecting the pieces. The relative positions of the housing 6 and lever 10 in the mold are represented in FIG. 2. The use of the two piece lever 10 allows the first member 77 and the second member 79 to be molded in the same mold as the housing 6. In addition, as the members 77, 79 may be spaced apart, the members 77, 79 may be molded in close proximity to the housing 6, thereby minimizing the dimensions needed for the mold and allowing the material to flow easily to all components during the molding process. This facilitates productions and assembly of the plug housing 6 and lever 10.

As the housing 6, first member 77 and second member 79 are molded in the same housing, the housing, first member and second member are ejected from the mold at the same time. The parts are, therefore, provided in proximate relationship to each other and are maintained in position due to the webs 91, 93, thereby facilitating assembly of the first and second members 77, 79 to the housing 6. As the housing 6 and the associated first member 77 and second member 79 are molded together, the assembly of the parts can be precisely and cost effectively accomplished.

Figure 5:
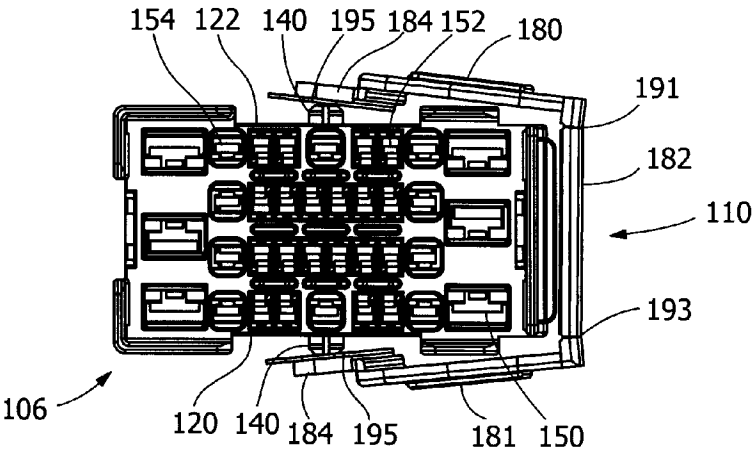
FIG. 5 is a top view of components of an alternate exemplary header assembly showing the relative position of a housing and a lever during molding of the components.

As best shown in FIGS. 5 through 7, an alternate exemplary plug housing 106 has oppositely facing sidewalls 120 and 122. Sidewalls 120 and 122 each include a pivot mount or mounting portion 140 in the form of a cylindrical pin. The plug housing 106 includes terminal receiving cavities such as 150, 152, and 154. In the exemplary embodiment shown, the cavities 150, 152, and 154 extend between a mating face 170 (FIG. 7) and a terminal receiving face 172 (FIG. 7). However, other configurations of the terminal receiving cavities, the sidewalls and the pivot mount may be implemented without departing from the scope of the invention.

In the exemplary embodiment shown in FIGS. 5 through 7, the lever 110 has a first lever arm 180 connected to a handle 182 and a second lever arm 181 connected to the handle 182. Each lever arm 180, 181 is connected to a central hub 184. In the exemplary embodiment shown and as best shown in FIG. 7, each central hub 184 has a raised portion 186 which includes gear teeth 188. A central bore 200 extends entirely through the central hub 184 and is profiled to be received over mounting portion 140. However, other embodiments of the central hub may be substituted without departing from the scope of the invention.

The first lever arm 180 is movably, hingedly or pivotably connected to the handle 182 at the connection region 191. The connection region 191 is molded to provide a weakened area about which the first lever arm 180 can move, rotate or pivot relative to the handle 182. The second lever arm 181 is movably, hingedly or pivotably connected to the handle 182 at the connection region 193. The connection region 193 is molded to provide a weakened area about which the first lever arm 181 can move, rotate or pivot relative to the handle 182.

The plug housing 106 includes the termination of multiple insulated conductors (not shown) to multiple socket contacts (not shown), and then loading the contacts into the various apertures 150, 152, 154. It should also be appreciated that lever 110 is positionable over the pivot mount 140 such that the lever 110 is moveable between positions where the plug assembly may be inserted into header, to where the plug assembly is fully locked within the header.

Once assembled, the operation of the lever 110, plug housing 106 is identical to the operation of the lever, plug housing and plug assembly shown and described in co-pending U.S. patent application Ser. No. 12/409,643 filed on Mar. 24, 2009, which is hereby incorporated by reference herein. The incorporation of U.S. patent application Ser. No. 12/409,643 is meant to be illustrative rather than limiting and various features may be changed without departing from the scope of this invention.

As previously described, the lever 110 is comprised of the first lever arm 180, the second lever arm 181 and the handle 182. During manufacture of the plug housing 106 and the lever 110, the first lever arm 180 and the second lever arm 181 are molded such that the longitudinal axes of the first lever arm 180 and the second lever arm 181 are angled relative to the longitudinal axis of the sidewalls 120, 122. During manufacture of the plug housing 106 and the lever 110, the lever 110 is molded in one mold with the housing 106, as represented by FIG. 5. The lever 110 and the housing 106 are essentially separate pieces with weak webs 195 being positioned between the lever 110 and housing 106 to maintain each of the components in position relative to each other and allow the flow of material during molding to be facilitated. The webs 195 are positioned between the mounting portions 140 of the housing and the hubs 184 of the levers arms 180, 181. This maintains the lever arms 180, 181 in position relative to the mounting portions 140 when the lever 110 and housing 106 are ejected from the mold. The separation of lever 110 and the housing 106 in the mold allows the complete formation of all of the components.

Upon removal from the mold cavity and during assembly of the lever 10 to the plug housing 6, the first lever arm 180 and the second lever arm 181 are moved, pivoted or rotated relative to the handle 182, allowing the central hubs 184 of the first lever arm 180 and the second lever arm 181 to be moved toward respective mounting portions 140. As this occurs, the forces applied to the lever arms 180, 181 are sufficient to overcome the resistance of the webs 195, thereby breaking the connections between the between the housing 106 and the lever arms 180, 181. As this occurs, the central hub 184 of each lever arm 180, 181 is moved into engagement with the respective mounting portion 140, and the central bore 200 is received over mounting portion 140. This allows the lever 110 to operate in the manner previously described. Once the central bores 200 are properly mated to the mounting portions 140, the engagement of the central hubs 184 with the mounting portions 140 maintains the lever 110 in the position shown in FIGS. 6 and 7, thereby preventing the further movement, pivoting or rotation of the first and second lever arms 180, 181 relative to the handle 182.

According to the present invention, the housing 106 and lever 110 are molded as distinct and separate pieces but are molded in the same mold. The relative positions of the housing 106 and lever 110 in the mold are represented in FIG. 5. The use of the connection region 191 and connection region 193 allows first and second lever arms 180, 181 to be molded at an angle relative to the housing 106, which allows the housing 106 and lever 110 to be molded in the same mold as the housing 106 and in close proximity to the housing 6, thereby minimizing the dimensions needed for the mold and allowing the material to flow easily to all components during the molding process. This facilitates productions and assembly of the plug housing 106 and lever 110.

As the housing 106 and lever 110 are molded in the same mold, the housing and lever are ejected from the mold at the same time. The parts are, therefore, provided in proximate relationship to each other and are maintained in position due to the webs 195, thereby facilitating assembly of the lever 110 to the housing 106. As the housing 106 and the lever 110 are molded together, the assembly of the parts can be precisely and cost effectively accomplished.

In contrast to the exemplary embodiments shown and described, one piece levers, as known in the prior art, are not be manufactured in the same mold. Because of the dimensions and spacing of the prior art housing and levers, molding of the housing and lever in the same mold is not practical or cost effective. Therefore, once molded, the housing and lever must be moved together using additional machinery which adds to complexity of assembly and the expense of plug assembly. Therefore, the invention, as represented by the exemplary embodiments, is directed to a lever and method of manufacture which reduces the cost of manufacturing and assembly.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A lever for use with a plug housing, the lever comprising:

a first member having a first handle and a first lever arm, the first lever arm is connected to a first central hub having a first raised portion which includes a first gear tooth, a first central bore extends through the first central hub and is profiled to be received over a first mounting portion of the plug housing;

a second member having a second handle and a second lever arm, the second lever arm is connected to a second central hub having a second raised portion which includes a second gear tooth, a second central bore extends through the second central hub and is profiled to be received over a second mounting portion of the plug housing;

the first member having a projection which extends from an end of the first handle, the second member having a recess which is provide at an end of the second handle;

at least one first web provided between the projection of the first member and the recesses of the second member, the at least one first web maintaining the first handle and the second handle in an initial position relative to each other prior to the lever being inserted onto the housing;

wherein as the lever is moved into engagement with the housing, resistance of the at least one first web is overcome, allowing the first handle to be fully inserted into the second handle.

2. The lever as recited in claim 1, wherein the projection is provided at the end of the first handle which is spaced from the first lever arm.

3. The lever as recited in claim 2, wherein the recess is provided at the end of the second handle which is spaced from the second lever arm.

4. The lever as recited in claim 1, wherein the first central hub of the first lever arm is connected to the first mounting portion of the housing by a second web positioned between the first central hub of the first lever arm and the first mounting portion of the housing to maintain the first lever arm in an initial position relative to the first mounting portion and the housing, wherein as the lever is moved into engagement with the housing, resistance of the second web is overcome, allowing the first central hub of the first lever arm to engage the first mounting portion of the housing.

5. The lever as recited in claim 4, wherein the second central hub of the second lever arm is connected to a second mounting portion of the housing by a third web positioned between the second central hub of the second lever arm and the second mounting portion of the housing to maintain the second lever arm in an initial position relative to the second mounting portion and the housing, wherein as the lever is moved into engagement with the housing, resistance of the third web is overcome, allowing the second central hub of the second lever arm to engage the second mounting portion of the housing.

6. A lever for use with a plug housing, the lever comprising:

a first member having a first handle and a first lever arm, a first central hub of the first lever arm is connected to a first mounting portion of the housing, a first web is positioned between the first central hub of the first lever arm and the first mounting portion of the housing to maintain the first lever arm in an initial position relative to the first mounting portion and the housing;

a second member having a second handle and a second lever arm, a second central hub of the second lever arm is connected to a second mounting portion of the housing, a second web is positioned between the second central hub of the second lever arm and the second mounting portion of the housing to maintain the second lever arm in an initial position relative to the second mounting portion and the housing;

the first member having a projection which extends from an end of the first handle, the second member having a recess which is provide at an end of the second handle;

at least one third web provided between the projection of the first member and the recesses of the second member, the at least one third web maintaining the first handle and the second handle in the initial position relative to each other prior to the lever being inserted onto the housing;

wherein as the lever is moved into engagement with the housing, resistance of the first web, the second web and the at least one third web is overcome, allowing the first central hub of the first lever arm to mounted on the first mounting portion of the housing, the second central hub of the second lever arm to be mounted on the second mounting portion of the housing, and the first handle to be fully inserted into the second handle.

7. The lever as recited in claim 6, wherein the mounting of the first and second lever arms with the first and second mating portions prevents further movement of the first handle relative to the second handle.

8. The lever as recited in claim 6, wherein the first central hub has a first raised portion which includes a first gear tooth and a second gear tooth.

9. The lever as recited in claim 8, wherein a first central bore extends through the first central hub and is profiled to be received over the first mounting portion of the housing.

10. The lever as recited in claim 9, wherein the second central hub has a second raised portion which includes a third gear tooth and a fourth gear tooth.

11. The lever as recited in claim 10, wherein a second central bore extends through the second central hub and is profiled to be received over the second mounting portion of the plug housing.

12. A lever for use with a plug housing, the lever comprising:

a first member having a first lever arm, the first lever arm connected to a first mounting portion of the housing by a first web positioned between the first lever arm and the first mounting portion of the housing to maintain the first lever arm in an initial offset position relative to the first mounting portion of the housing;

a second member having a second lever arm, the second lever arm connected to a second mounting portion of the housing by a second web positioned between the second lever arm and the second mounting portion of the housing to maintain the second lever arm in an initial offset position relative to the second mounting portion of the housing;

wherein as the lever is moved into engagement with the housing, resistance of the first web and the second web is overcome, breaking the connection between the first mounting portion of the housing and the first lever arm and breaking the connection between the second mounting portion of the housing and the second lever arm allowing the first lever arm to be mounted on the first mounting portion and the second lever arm to be mounted on the second mounting portion.

13. The lever as recited in claim 12, wherein:

the first lever arm is movably, hingedly or pivotably connected to a handle at a first connection region, the first connection region being formed to provide a weakened area about which the first lever arm can move, rotate or pivot relative to the handle;

the second lever arm is movably, hingedly or pivotably connected to the handle at a second connection region, the second connection region being formed to provide a weakened area about which the second lever arm can move, rotate or pivot relative to the handle.

14. The lever as recited in claim 13, wherein the first and second lever arms are mated with first and second mating portions of the housing, wherein the mating of the first and second lever arms with the first and second mating portions prevents further movement, pivoting or rotation of the first and second lever arms relative to the handle.

15. The lever as recited in claim 13, wherein the first central hub has a first raised portion which includes a first gear tooth and a second gear tooth.

16. The lever as recited in claim 15, wherein a first central bore extends through the first central hub and is profiled to be received over the first mounting portion of the housing.

17. The lever as recited in claim 16, wherein the second central hub has a second raised portion which includes a third gear tooth and a fourth gear tooth.

18. The lever as recited in claim 17, wherein a second central bore extends through the second central hub and is profiled to be received over the second mounting portion of the plug housing.

* * * * *